US005431385A

United States Patent [19]

Holbrook

[11] Patent Number: 5,431,385

[45] Date of Patent: Jul. 11, 1995

[54] INGESTION ROLLER FOR MIXED MAIL FEEDER

[75] Inventor: Russell W. Holbrook, Southbury, Conn.

[73] Assignee: Pitney Bowes Inc., Stamford, Conn.

[21] Appl. No.: 344,788

[22] Filed: Nov. 23, 1994

Related U.S. Application Data

[63] Continuation of Ser. No. 205,231, Mar. 3, 1994, abandoned.

[51] Int. Cl.[6] ..... B65H 3/52

[52] U.S. Cl. ..... 271/122; 271/274

[58] Field of Search ..... 271/2, 10, 121, 122, 271/124, 125, 273, 274

[56] References Cited

U.S. PATENT DOCUMENTS

| | | | |
|---|---|---|---|
| 4,216,952 | 8/1980 | McInerny | 271/10 |
| 4,376,530 | 3/1983 | Akai | 271/10 |
| 4,695,048 | 9/1987 | Görner et al. | 271/122 |
| 4,909,499 | 3/1990 | O'Brien et al. | 271/273 X |
| 4,978,144 | 12/1990 | Holbrook | 271/122 |
| 5,143,366 | 9/1992 | Svyatsky | 271/122 |
| 5,295,675 | 3/1994 | Hain | 271/122 X |

FOREIGN PATENT DOCUMENTS

| | | | |
|---|---|---|---|
| 110569 | 8/1979 | Japan | 271/122 |
| 176239 | 7/1988 | Japan | 271/121 |
| 89741 | 3/1990 | Japan | 271/121 |

*Primary Examiner*—H. Grant Skaggs

*Attorney, Agent, or Firm*—Lawrence E. Sklar; Melvin J. Scolnick

[57] ABSTRACT

Apparatus for feeding mixed mail in a mailing machine. The apparatus includes: a feed deck for stacking and feeding a plurality of envelopes; a device for urging the lowermost envelope along the feed deck; a feed roller located downstream of the urging device; a restraint belt system located above the feed roller, the downstream end of the belt system defining a feed nip with the feed roller; and an ingestion roller biased against the feed roller upstream of the feed nip.

6 Claims, 5 Drawing Sheets

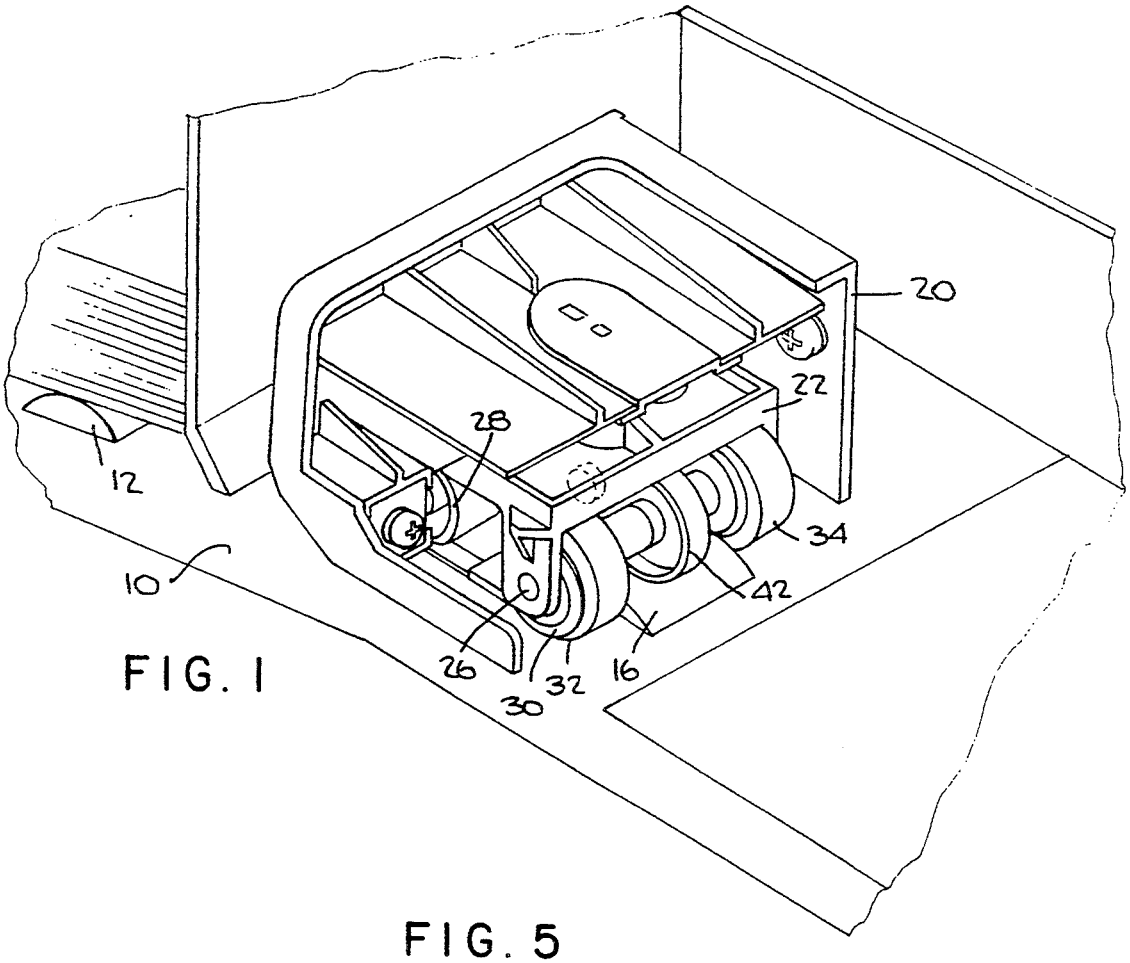
FIG. 1
FIG. 5
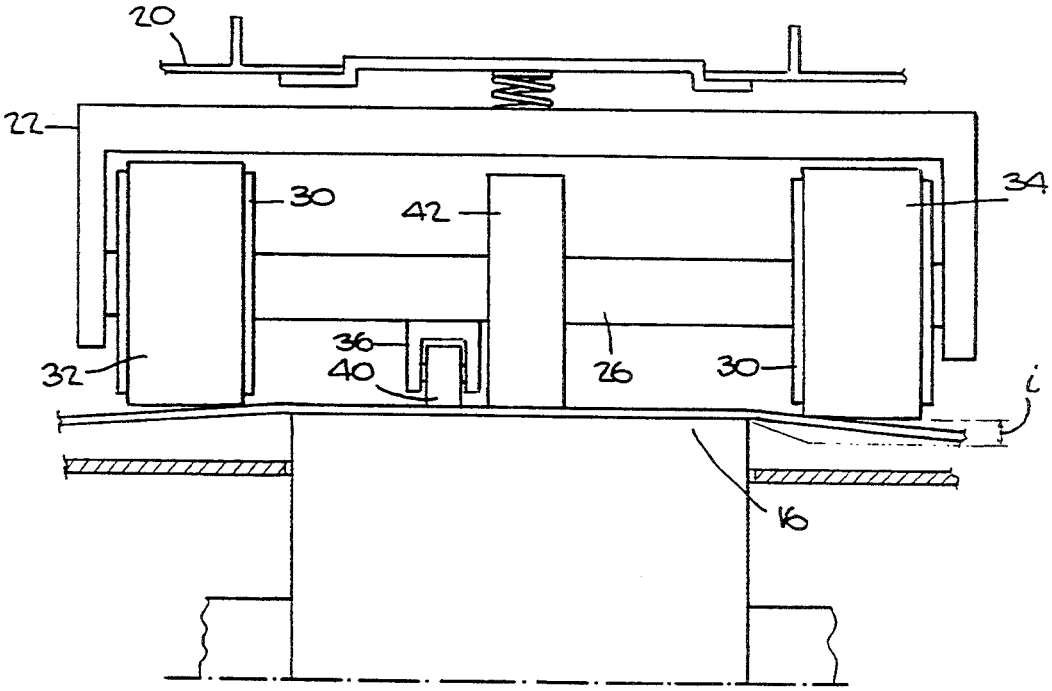

INGESTION ROLLER FOR MIXED MAIL FEEDER

This application is a continuation of application Ser. No. 08/205,231, filed Mar. 3, 1994 now abandoned.

BACKGROUND OF THE INVENTION

The instant invention relates to mailing machines, and more particularly to a feeding system in a mailing machine for handling mail envelopes of varying size and thickness.

State of the art mailing machines can perform such automatic functions as handling mail of different sizes and thicknesses, envelope sealing, mail weighing, mail stamping and mail sorting. The typical processing sequence starts at the front end of the machine where the mail is stacked. The stacked mail is then registered against a reference wall of the machine and the next step in the process is to feed the mail to a singulator to remote individual mail pieces from the bottom of the stack and thereafter process those individual mail pieces seriatim through the various modules of the machine.

Special problems arise when the mail to be handled is mixed mail, meaning envelopes containing inserts that have their flaps sealed, or closed but unsealed, or open. The problems intensify when an added requirement is the ability to process envelopes of varying sizes, for example from thin air mail with a single insert up to thicknesses of about half an inch.

Prior art mixed mail feeding devices have employed belts to feed and singulate the stack of mixed mail. Located above the feeding belt is a singulating device in the form of a restraint belt system for holding back the pieces of mail sitting on top of the lowermost piece of mail which is to be singulated through the singulator for further processing. However, a feeding belt system is expensive and complex and requires significant motor power to run and consumes a significant amount of length in the path of the mailing machine.

Accordingly, the instant invention provides a mixed mail feeding device which is considerably less expensive than a belt feeding system, requires less motor power to run than a belt system, and has a shorter path than a belt feeding system.

SUMMARY OF THE INVENTION

Thus, the instant invention provides apparatus for feeding mixed mail in a mailing machine. The apparatus includes: a feed deck for stacking and feeding a plurality of envelopes; means for urging the lowermost envelope along the feed deck; a feed roller located downstream of the urging means; a restraint belt system located above the feed roller, the downstream end of the belt system defining a feed nip with the feed roller; and an ingestion roller biased against the feed roller upstream of the feed nip.

BRIEF DESCRIPTION OF THE DRAWING

FIG. 1 is a perspective view of a mixed mail singulating device in accordance with the instant invention;

FIG. 5 is an elevational view of the singulating device seen in FIG. 1 as an envelope sees the feed roller and ingestion roller;

DETAILED DESCRIPTION OF THE PREFERRED EMBODIMENT

Figure 2:
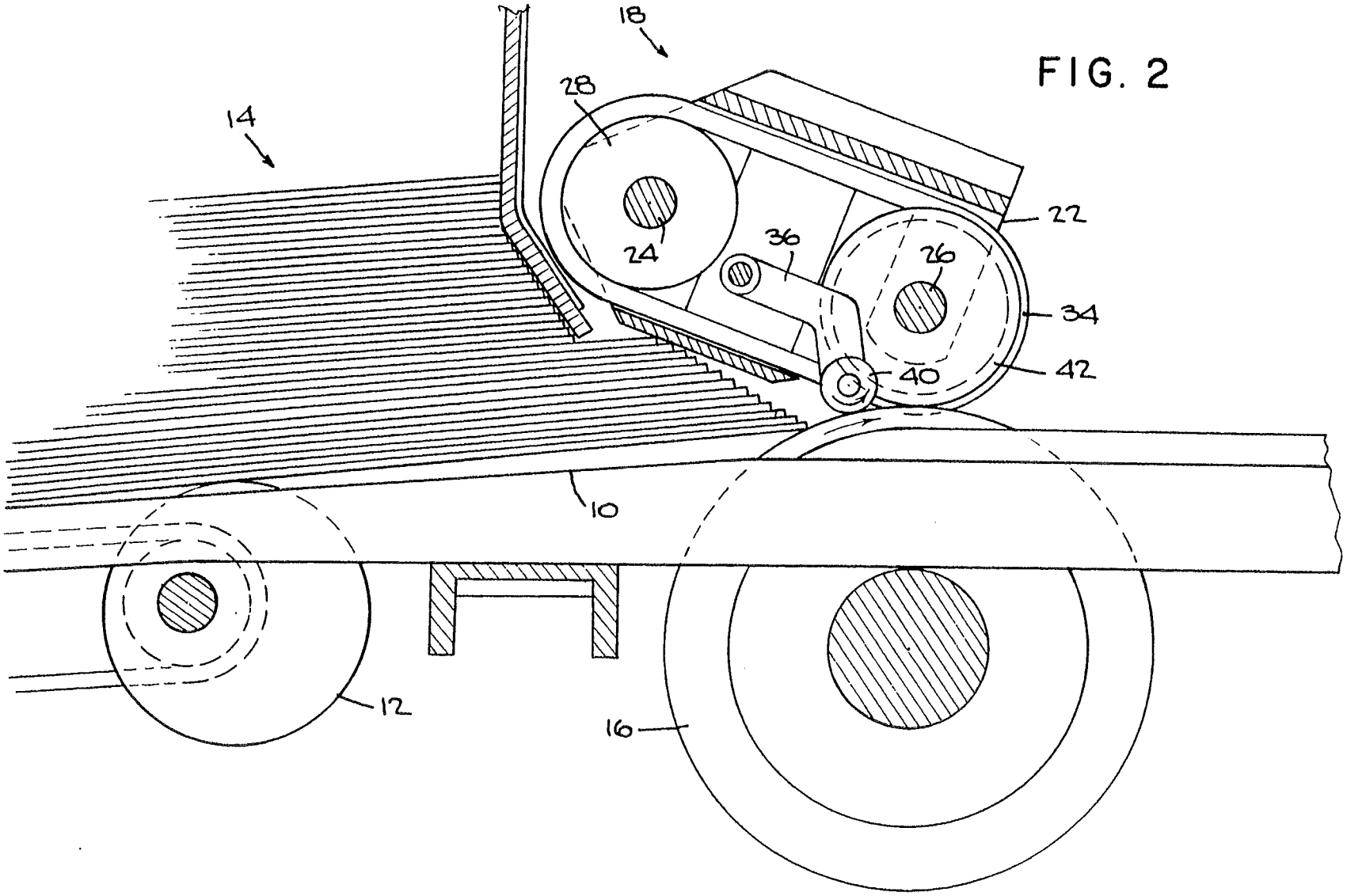
FIG. 2 is a side, elevational view of the singulating device seen in FIG. 1 and the feed roller with which it is associated.

In describing the preferred embodiment of the instant invention, reference is made to the drawings, wherein there is seen a feed deck 10 of a mailing machine (not generally shown) and a nudger roller 12 for advancing filled envelopes 14 placed on the feed deck 10 toward a feed roller 16. Located above the feed roller 16 is a restraint belt system generally designated 18. Situated downstream of the feed roller 16 is a take-away roller (not shown).

Figure 8:
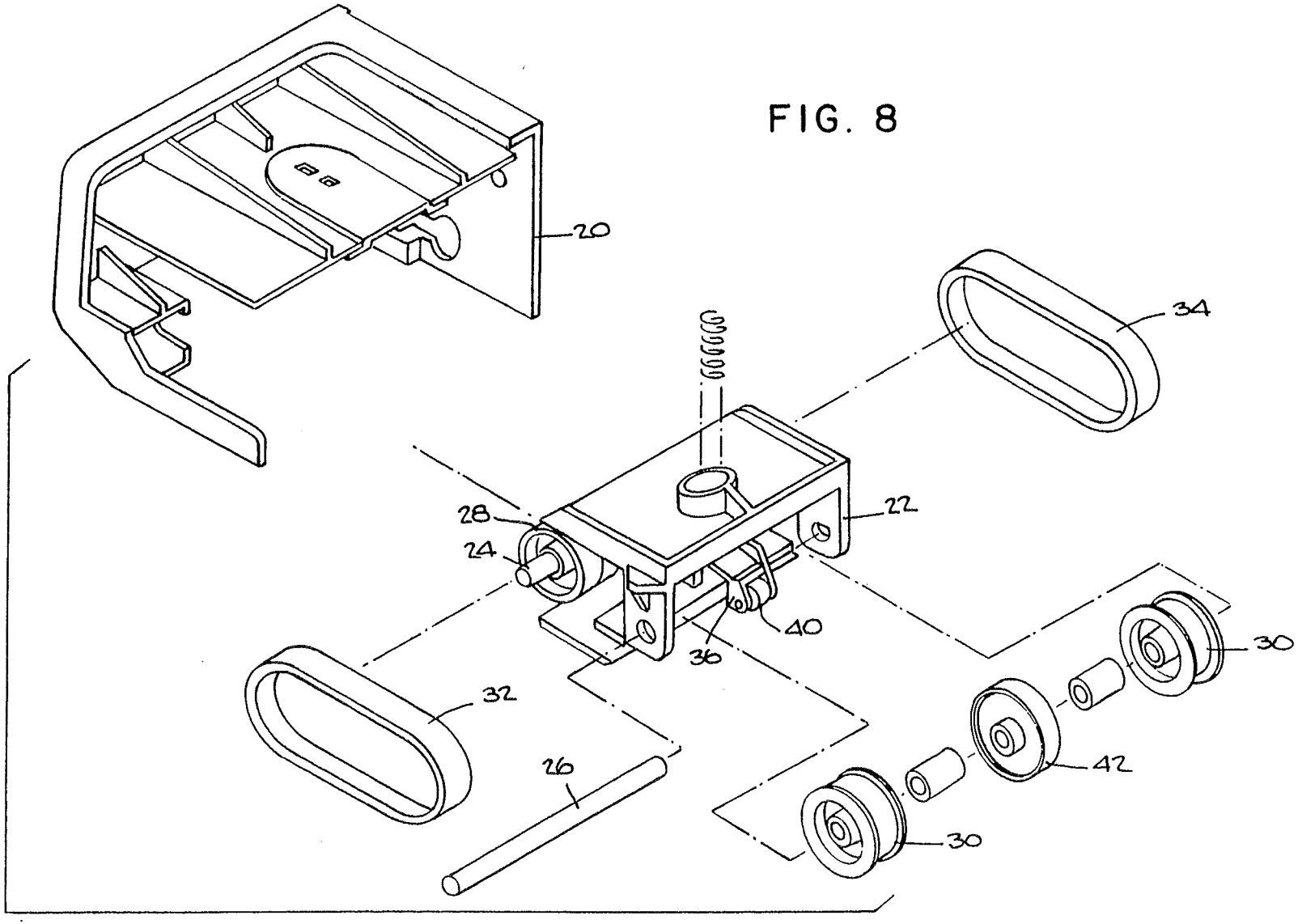
FIG. 8 is an exploded, perspective view of the singulating device seen in FIG. 1.

The restraint belt system 18 consists (see FIG. 8) of a housing 20 which supports and receives a frame member 22 which houses a pair of shafts 24 and 26. A pair of pulleys 28 are mounted on the shaft 24 and a pair of pulleys 30 are mounted on the shaft 26. A pair of belts 32 and 34 are each mounted on the pulleys 28 and 30. Pivotably mounted to the housing 20 is a spring-loaded arm 36 located intermediate the two belts 32 and 34. At the end of the arm 36 is an ingestion roller 40 (see FIG. 2) which is biased against the feed roller 16 at its upstream end prior to the nip of the roller 16 and the belts 32 and 34. The ingestion roller 40 is free-wheeling and is biased with a force of between about two and eight ounces. A center roller 42 is mounted on the shaft 26 and sets the amount of interleaving "i" (see FIG. 5) between the restraint belts 32 and 34 and the feed roller 16. It can be seen that the diameter of the ingestion roller 40 is a small fraction of the diameter of the feed roller 16 and that the width of the ingestion roller 40 is also a small fraction of the width of the feed roller 16. Typically, the diameter of the ingestion roller 40 is between about 10 and 15% of the diameter of the feed roller 16. The feed roller 16 is driven to rotate in a clockwise direction, but the restraining belts 32 and 34 are driven to rotate in a clockwise direction in order to effect singulation, as explained more fully hereinbelow.

Figure 3:
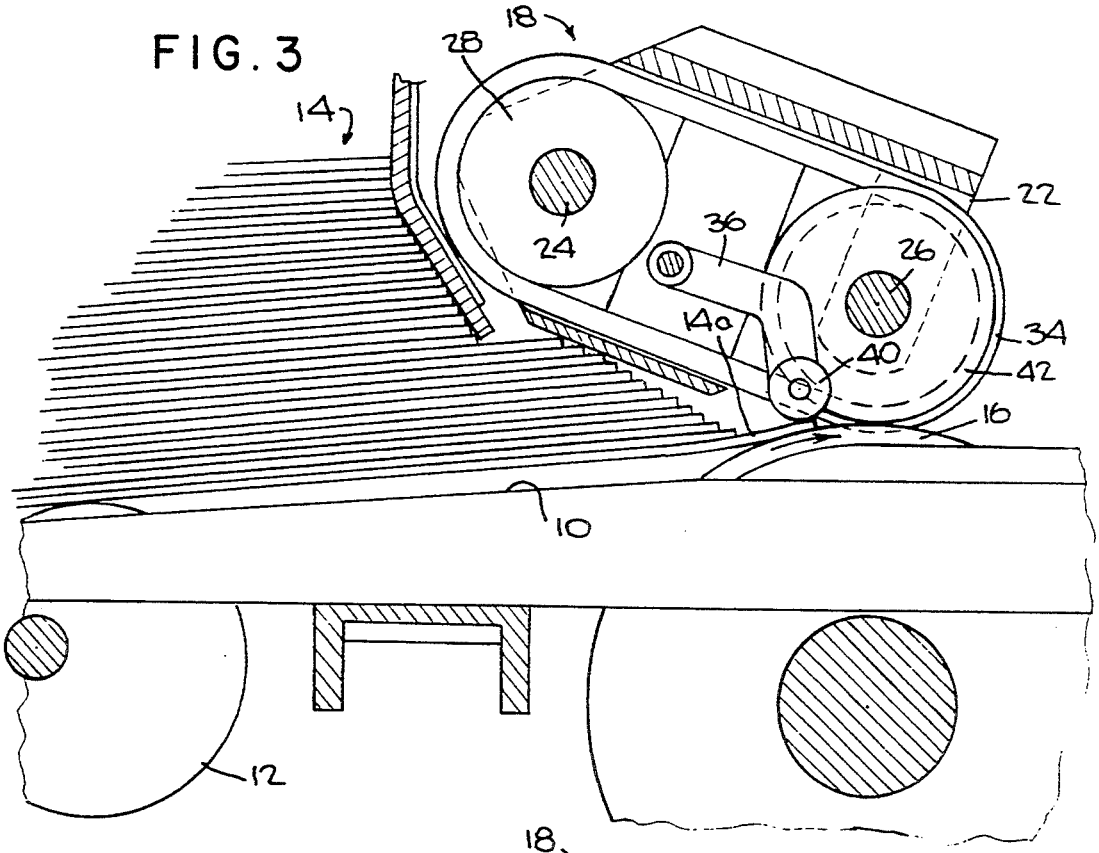
FIG. 3 is similar to FIG. 2 but shows a filled envelope entering the nip of the feed roller and ingestion roller.
Figure 4:
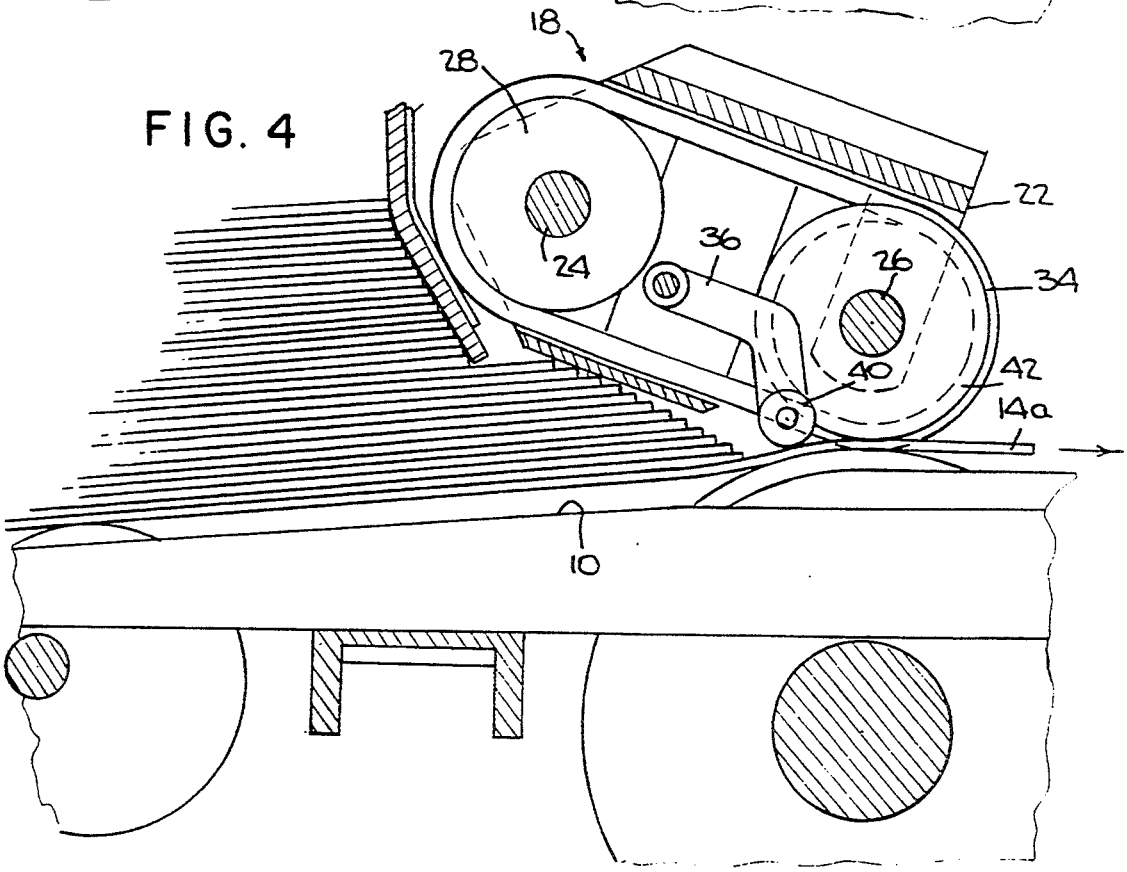
FIG. 4 is similar to FIG. 3 but shows the filled envelope exiting the nip of the singulating device and the feed roller.

Referring now to FIG. 3, there is seen a single envelope **14*a*, which is the lowermost envelope from the stack of envelopes 14, at the nip of the ingestion roller 40 and the feed roller 16. In the case of a single envelope 14*a* as seen in FIG. 3, the ingestion roller 40 functions to drive the envelopes 14*a* into the feed nip defined by the feed roller 16 and the belts 32 and 34 because the two rollers 16 and 40 oppose each other and both have a high co-efficient of friction and both are turning in the direction of feed. The ingestion roller 40 is capable of pulling in even a turned-up lead edge of a spindled envelope. FIG. 4 shows the envelope 14*a* exiting the nip of the feed roller 16 and the restraining belts 32 and 34**.

Figure 6:
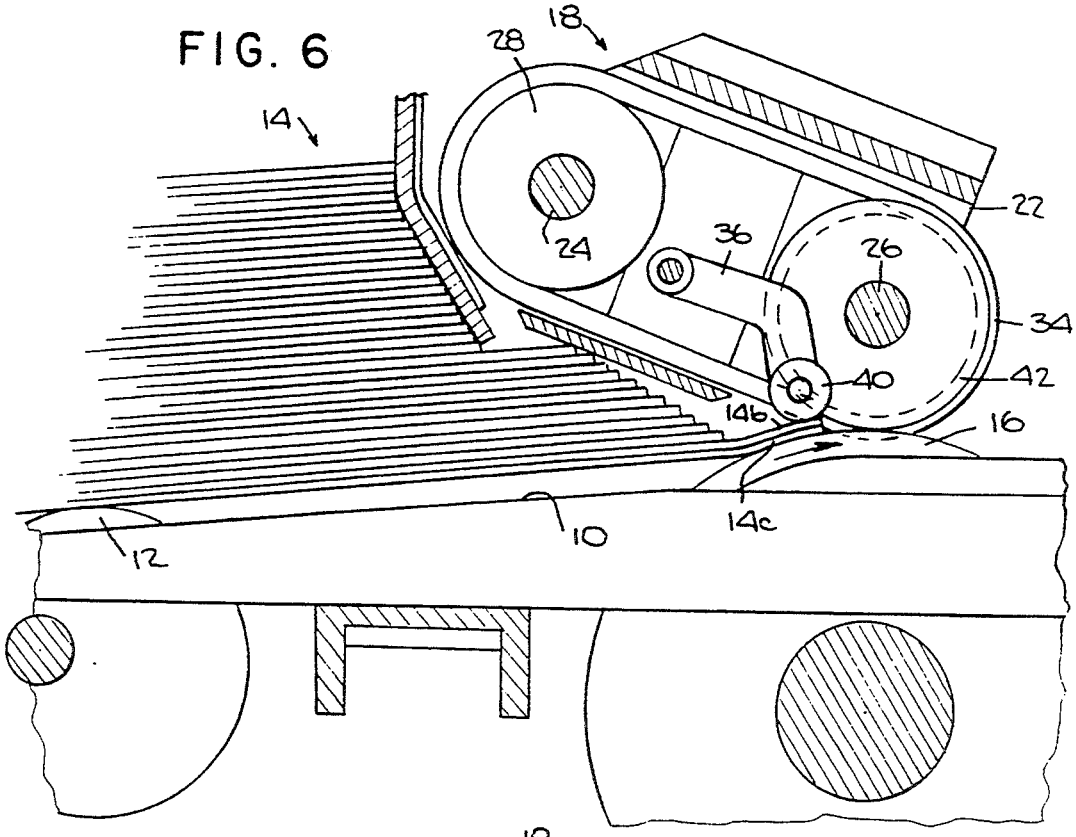
FIG. 6 is similar to FIG. 3 but shows two filled envelopes entering the nip of the feed roller and ingestion roller.
Figure 7:
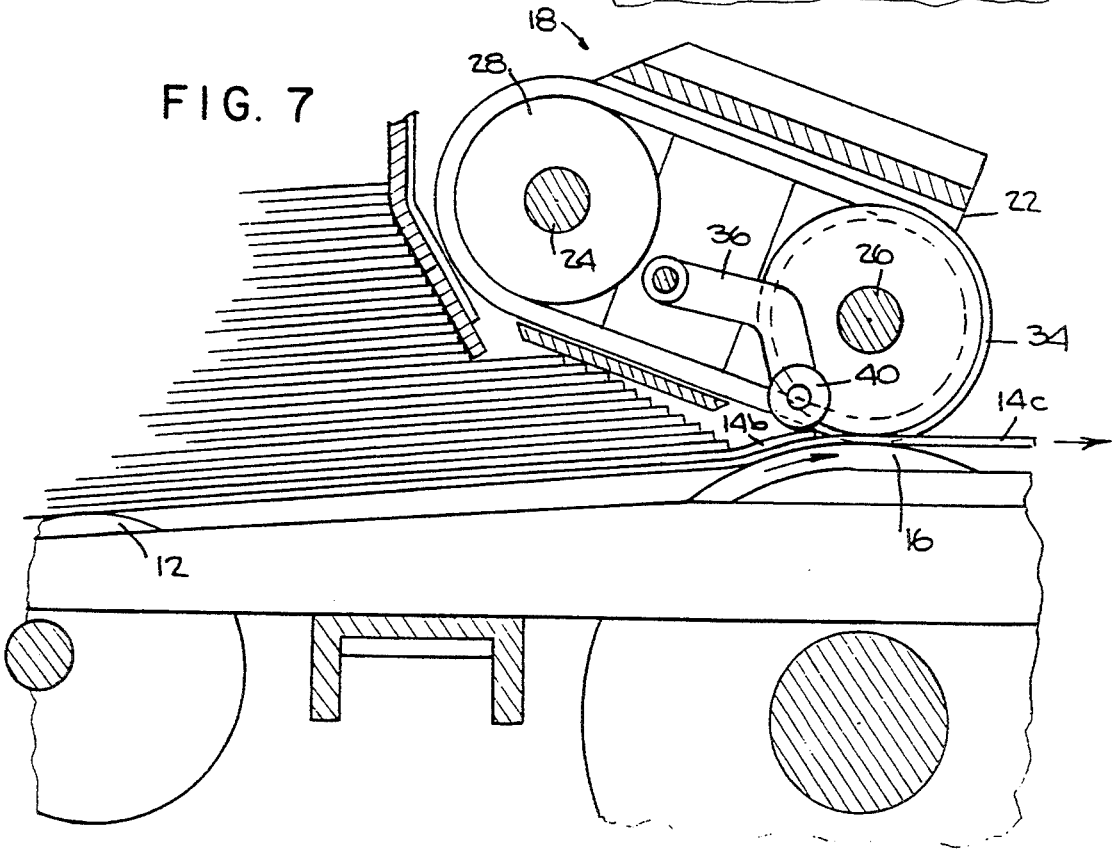
FIG. 7 is similar to FIG. 6 but shows the lowermost, filled envelope exiting the nip of the feed roller and singulating device.

Referring now to FIG. 6, there is seen a pair of envelopes **14*b* and 14*c*, envelope 14*c* being the lowermost envelope in the stack of envelopes 14, and 14*b* being located immediately above the envelope 14*c*. The pair of envelopes 14*b* and 14*c* are located at the nip of the ingestion roller 40 and the feed roller 16. In the case of two envelopes 14***b* and 14*c* at the nip of the roller 40 and 16, the lower envelope 14*c* sees a normal force but the ingestion roller 40 stops turning because it is lifted off the feed roller 16 and just acts as a normal force that actually allows the restraint belts 32 and 34 to push back the upper envelope 14*b* or any other envelopes 14 resting above the lowermost envelope 14*c* and prevent double feeds of any envelopes 14. FIG. 7 shows the lowermost envelope 14*c* being driven through the nip of the feed roller 16 and the restraining belts 32 and 34.

From the foregoing description it can be seen that the ingestion roller 40 acts as a non-restrictive normal force just prior to the nip defined by the feed roller 16 and the belts 32 and 34. The force is non-restrictive in that it does not restrict downstream movement of the envelopes 14 as it imparts a normal force to create a driving traction against the feed roller 16.

It should be understood by those skilled in the art that various modifications may be made in the present invention without departing from the spirit and scope thereof, as described in the specification and defined in the appended claims.

What is claimed is:

1. Apparatus for feeding mixed mail in a mailing machine, comprising:

a feed deck for stacking and feeding a plurality of filled envelopes, said envelopes having either sealed flaps or open flaps or closed but unsealed flaps, and said envelopes having varying thicknesses up to about one half inch;

means for urging the lowermost envelope along said feed deck;

a feed roller located downstream of said urging means;

a restraint belt system located above said feed roller, said system having (a) a center roller defining a feed nip with said feed roller, and (b) a pair of rotating belts laterally spaced from the sides of said feed roller, said belts rotating against the direction of feeding said mail; and an ingestion roller biased against said feed roller upstream of said feed nip.

2. The apparatus of claim 1, wherein said urging means comprises a nudger roller.

3. The apparatus of claim 1, wherein said restraint belt system includes a housing.

4. The apparatus of claim 3, additionally comprising a spring loaded arm pivotably mounted to said housing, and wherein said ingestion roller is secured to the end of said spring loaded arm.

5. The apparatus of claim 4, wherein said ingestion roller is biased with a force of between about two and eight ounces.

6. The apparatus of claim 4, wherein the diameter of said ingestion roller is between about 10 and 15% of the diameter of said feed roller.

* * * * *